United States Patent [19]

Owens

[11] 4,400,967

[45] Aug. 30, 1983

[54] CRIMPING COLLET

[76] Inventor: Carl H. Owens, 1652 River Bluff Rd., Jacksonville, Fla. 32211

[21] Appl. No.: 298,167

[22] Filed: Aug. 31, 1981

[51] Int. Cl.[3] ..... B21D 41/00

[52] U.S. Cl. ..... 72/402; 29/237; 72/416

[58] Field of Search ..... 72/402, 410, 416, 412; 29/237; 279/1 Q, 26

[56] References Cited

U.S. PATENT DOCUMENTS

| | | | |
|---|---|---|---|
| 2,346,706 | 4/1944 | Stoner | 279/46 |
| 2,374,245 | 4/1945 | Stoner | 279/46 |
| 2,459,900 | 1/1949 | Stoner | 279/1 Q |
| 2,784,976 | 3/1957 | Ondeck | 279/1 Q |
| 3,325,166 | 6/1967 | McCarthy | 279/1 Q |
| 3,750,452 | 8/1973 | Frank | 29/237 |
| 3,851,514 | 12/1974 | Chen | 29/237 |
| 4,034,593 | 7/1977 | Patel | 29/237 |
| 4,285,228 | 8/1981 | Gunning | 29/237 |

*Primary Examiner*—Gene Crosby

*Attorney, Agent, or Firm*—Arthur G. Yeager

[57] ABSTRACT

A collet for crimping a metallic fitting onto a flexible elastomeric hose which comprises a frustoconical structure having a top surface, a bottom surface, an outer conical surface, and a central axial bore adapted to encircle the fitting and the hose; said structure comprising a plurality of separate, identical, radial sectors, each adjacent pair of said sectors being separated from each other by an elastomeric pad, said structure being held together as a unit by a circumferential elastomeric ring engaged in a groove in said conical surface.

10 Claims, 3 Drawing Figures

FIG.1
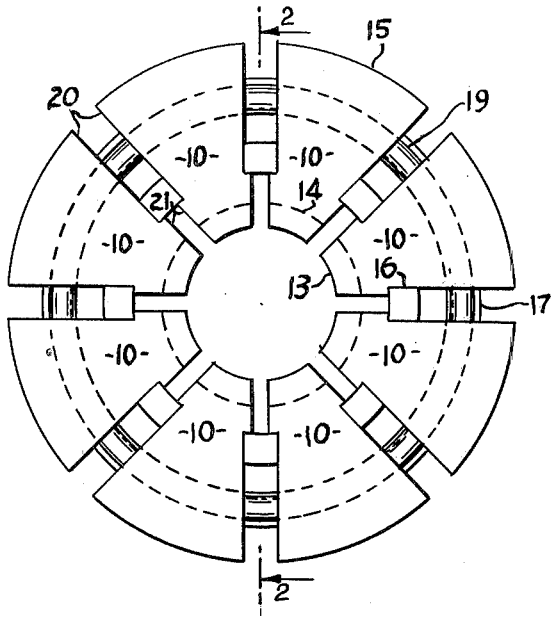
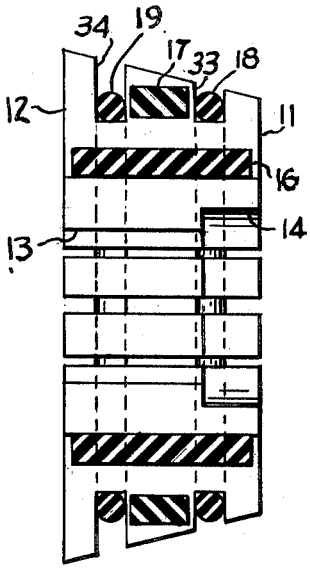
FIG.2
FIG.3
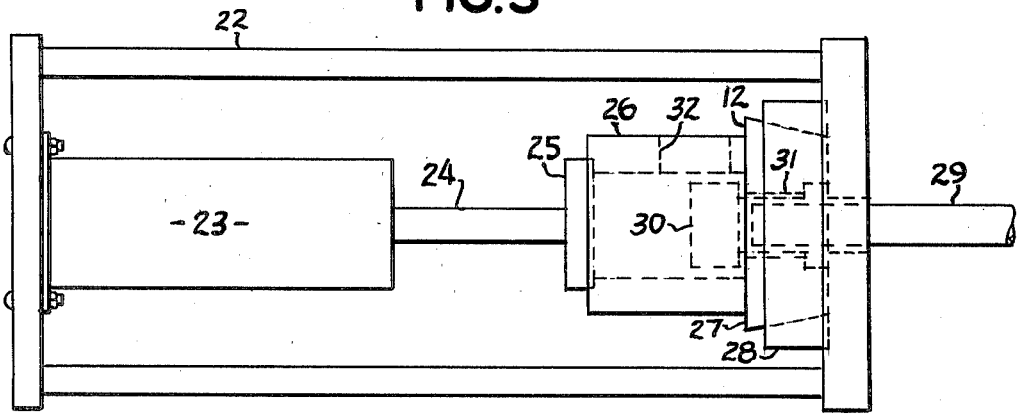

CRIMPING COLLET

BACKGROUND OF THE INVENTION

In order to attach a metal fitting, such as a threaded connection, to a flexible rubber hose it is necessary to assemble the metallic fitting and the hose into their proper positioning and then to crimp the metallic fitting around the hose to form a tight connection that will not permit leakage of the fluid carried in the hose. The crimping action involves a high pressure pinching or swaging of the metal sleeve, reducing the diameter of the sleeve so as to form a tight connection with the rubber hose. The pinching or the swaging action has been performed in the past in many ways, including a drop-hammer pounding the metal of the fitting while it is resting against an anvil. More recently the use of hydraulic pressure devices have permitted the same action to occur through a single stroke of a high pressure ram against a collet wherein a plurality of metal fingers are pressed inwardly around the outer surface of the metallic fitting that is to be crimped. The structure of such a collet is normally a cylindrical or frustoconical member divided into a plurality of individual sectors around a central axial bore. The sectors are spaced apart from each other in the expanded mode so as to permit the metallic fitting which is to be crimped to be placed in the central bore. The sectors are then compressed in radial directions so as to make the central bore smaller causing the fingers of the sectors to work the metal fitting and to reduce its diameter. In this fashion the metal fitting can be crimped upon a flexible hose or other article to which the fitting is to be attached. Such collets have been produced in the past with many types of devices for holding the several sectors together into a single compressible unit. Combinations of springs, levers, and screws have been employed in the past to hold the assembled unit in an expanded condition and yet to permit the unit to contract when subjected to radial forces.

It is an object of this invention to provide an improved crimping collet. It is another object of this invention to provide an improved method of holding a multi-sectored collet together in a compressible condition. It is still another object of this invention to provide an improved frustoconical collet to be employed with a hydraulic ram system. Still other objects will be apparent from the more detailed description of this invention which follows.

BRIEF SUMMARY OF THE INVENTION

This invention provides a collet for crimping a metallic fitting onto a flexible elastomeric hose which comprises a frustoconical structure having a top surface, a bottom surface, an outer conical surface, and a central axial bore adapted to encircle said fitting and said hose, said structure comprising a plurality of separate, identical, radical sectors, each adjacent pair of said sectors being separated from each other by an elastomeric pad, said structure being held together as a unit by a circumferential elastomeric ring engaged in a groove in said conical surface. In a specific embodiment of this invention there are eight radial sectors which are separated from each other by two sets of elastomeric pads, one being positioned adjacent the bore and the other being positioned adjacent the conical surface, and the entire structure being held together by two elastomeric rings engaged in grooves, one of said grooves being adjacent to and parallel to the top surface while the other groove is adjacent to and parallel to the bottom surface.

BRIEF DESCRIPTION OF THE DRAWINGS

The novel features believed to be characteristic of this invention are set forth with particularity in the appended claims. The invention, however, both as to its organization and method of operation together with further objects and advantages thereof, may best be understood by reference to the following description taken in connection with the accompanying drawings in which:

FIG. 1 is an overhead plan view of the collet of this invention.

FIG. 2 is a cross sectional view taken at 2—2 as shown in FIG. 1.

FIG. 3 is a schematic illustration of a crimping apparatus employing the collet of this invention.

DETAILED DESCRIPTION OF THE INVENTION

In FIGS. 1 and 2 the structure of the collet of this invention may be seen. The collet is made of a plurality of sectors 10 which, when assembled produce a cylindrical or conical member having a central axial bore 13 wherein the crimping occurs. The number of individual sectors 10 in any one assembled collet may vary depending upon the type and size of fitting which is to be crimped thereby. There must be at least two such sectors 10 so that they may be positioned in the expanded mode to receive a fitting and a hose and then be squeezed together to cause crimping of the fitting around the hose. It is generally preferred to have at least four sectors 10 so that the crimping action is applied somewhat equally over the entire surface of the fitting to be crimped. In these drawings there is shown the preferred arrangement of eight sectors 10 which are each identical and having an inside surface which is cylindrical, such that when assembled and compressed radially they combine to form bore 13.

The crimping action is accomplished by forcing the sectors 10 to move radially toward the central axial bore 13 causing that bore to be smaller in diameter as more force toward the center is applied. Such a radial force can be applied in any of several well known ways, the choice of which will dictate the shape of the outside surface 15. In the preferred embodiment of this invention outside surface 15 is conical and sectors 10 are squeezed together by applying an axial force against bottom surface 12 while the collet is seated in a tapered ring encircling conical surface 15 thus transforming the axial force into a radial force, as will be more completely described below.

Sectors 10 are held apart in the assembled expanded mode by reason of elastomeric pads between adjacent sectors 10. These pads serve the purpose of maintaining the collet in its expanded mode when it is not under the radial forces necessary to cause crimping. Such pads are preferably in the form of rectangular prisms. There may be one or more pads between adjacent sectors 10. In FIGS. 1 and 2 there are shown two separate sets of pads, such that pads 16 and 17 are positioned between each pair of adjacent sectors 10. Each pair of pads 16 and 17 could be connected to each other to produce a single pad, or they could be placed in different locations than those shown in the drawings and still be within the spirit of this invention. It is only necessary that the pads be elastomeric and that they fit between each pair of adjacent sectors 10 so as to hold them in the spaced relationship of the expanded mode. In the preferred embodiment as shown here there are two sets of pads, one being adjacent conical surface 15 and the other being adjacent bore 13 and thus producing a stable seating for each adjacent pair of sectors 10. In order to maintain the pads in the same position through the operations of compressing and relaxing the collet, the pads are bonded by a suitable cement to one of the sectors 10 contacting the pad but not to both of the contacting sectors. This permits ease of assembly or disassembly while maintaining the pads in a fixed chosen position.

In order to hold the entire collet together as a single compressible unit there is employed a ring of elastomeric material encircling all of the sectors in the assembled position. In the preferred embodiment shown in these drawings there are employed two separate rings 18 and 19 engaged in grooves 33 and 34, respectively. Groove 33 is adjacent to and parallel to top surface 11 and groove 34 is adjacent to and parallel to bottom surface 12. This invention is intended to cover an assembly having a single ring and groove or more than two rings and grooves employed to hold the plurality of sectors 10 into a single compressible unit. The arrangement shown here is preferred because of its simplicity and stability.

The particular composition of elastomeric pads 16 and 17 and of elastomeric rings 18 and 19 is not critical, it is only necessary that they be sufficiently resilient to be compressed during the crimping operation and to recover causing the sectors 10 to be restored to the expanded mode of the collet as shown in these drawings. A particularly suitable material for rings 18 and 19 is surgical tubing, and for pads 16 and 17 is sythetic rubber.

The application and use of the collet of this invention is shown in one embodiment in the illustration of FIG. 3. Frame 22 is a rigid structure of sufficient size and shape to withstand the forces produced in the crimping operation. Hydraulic cylinder 23 includes ram 24 to which is attached pusher plate 25 that seats in one end of hollow cylinder 26 which, in turn, presses against bottom surface 12 of collet 27. While in its expanded mode as shown in FIGS. 1 and 2 fitting 30 is inserted into bore 13 of collet 27 and hose 29 is placed inside of fitting 30. Collet 27 is mated with tapered seat 28 which rests against frame 22. Power is applied through hydraulic cylinder 23 to move ram 24 outwardly toward collet 27. The force of ram 24 is transmitted through plate 25 and cylinder 26 to bottom surface 12 of collet 27, pushing collet 27 deeper into tapered seat 28 and thus causing crimping surfaces 31 (which are the same as bore 13 in FIGS. 1 and 2) to close tightly onto the fitting in collet 27. As ram 24 moves farther outwardly crimping surfaces 31 close on the outside surface of fitting 30 and crimping it tightly onto hose 29. Power is then released through hydraulic cylinder 23 and the completed hose 29 with fitting 30 attached can be removed from collet 27.

If fitting 30 has an elbow or other lateral projection cylinder 26 can be fashioned with a lateral passageway 32 to accommodate such a fitting during the crimping operation. If the fitting 30 should be a tee there can be two such passageways 32 to accommodate that fitting. Other arrangements are suitable to accommodate any other type of fitting.

While the invention has been described with respect to certain specific embodiments it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A collet for crimping a metallic fitting onto a flexible elastomeric hose which comprises a generally cylindrical structure having a top surface, a bottom surface, an outer circumferential surface, and a central axial bore adapted to encircle the fitting and the hose, said structure including a plurality of separate identical radial sectors, each adjacent pair of said sectors being separated from each other by an elastomeric pad bonded to only one said sector of said pair, each said sector having a groove in its outer surface forming said circumferential surface, said structure including at least one circumferential elastomeric ring engaged in each said groove to elastically retain said sectors together as a unit and permitting contraction and expansion of said collet, each said sector being individually removable and replaceable without disturbing any bonding of said pad to one said sector.

2. The collet of claim 1 wherein said circumferential surface is conical.

3. The collet of claim 1 wherein said structure is held together as a unit by another circumferential ring, one said ring being disposed adjacent to and parallel to said top surface and said other ring being disposed adjacent to and parallel to said bottom surface.

4. The collet of claim 1 wherein each said sector is separated from the next adjacent sector by another spaced elastomeric pad, one said pad being adjacent said bore and said other pad being adjacent said conical surface.

5. The collet of claim 2 wherein each said sector is defined by said outer surface which is conical, a top planar surface and a bottom planar surface generally parallel to each other, an inner cylindrical surface, and two side surfaces that are generally planar and converge toward said cylindrical surface and diverge toward said conical surface, said side surfaces including a laterally projecting ledge adjacent said bore and extending remotely from said top surface to said bottom surface.

6. The collet of claim 6 wherein said ledge of each adjacent pair of sectors form a seat for said elastomeric pad.

7. In the combination of a crimping machine for attaching fittings to an elastomeric hose wherein a hydraulic ram presses a collet into a tapered seat to cause the jaws of the collet to crimp a fitting around a hose placed in the center bore of the collet, the improvement which comprises a collet having a frustoconical structure including a top surface, a bottom surface, an outer conical surface, and a central axial bore adapted to encircle the fitting and the hose, said structure including a plurality of separate identical radial sectors, each adjacent pair of said sectors being separated from each other by at least one elastomeric pad bonded to only one said sector of said pair, each said sector having a groove in its outer surface forming said circumferential surface, said structure including at least one circumferential elastomeric ring engaged in each said groove to elastically retain said sectors together as a unit and permitting contraction and expansion of said collet, each said sector being individually removable and replaceable without disturbing any bonding of said pad to one said sector.

8. The combination of claim 7 wherein said structure is held together as a unit by another elastomeric ring, one said ring being disposed and engaged in said groove adjacent to and parallel to said top surface and said other ring being disposed and engaged in another groove adjacent to and parallel to said bottom surface.

9. The combination of claim 7 wherein the facing surfaces of adjacent said sectors each contain a ledge projecting outwardly toward said adjacent section spaced downwardly from said top surface and upwardly from said bottom surface.

10. The combination of claim 7 including a second elastomeric ring, a second groove adjacent said bottom surface, and a second elastomeric pad between each said adjacent pair of said sectors, each said second pad being an elongated rectangular prism, said one pad being disposed adjacent said bore and said second pad being disposed adjacent said elastomeric rings, one said ring being in said groove adjacent said top surface and said second ring being in said second groove.

* * * * *